US005573560A

United States Patent [19]

Kobayashi et al.

[11] Patent Number: 5,573,560

[45] Date of Patent: Nov. 12, 1996

[54] ABRASIVE MEDIA CONTAINING A COMPOUND FOR USE IN BARREL FINISHING PROCESS AND METHOD OF MANUFACTURE OF THE SAME

[75] Inventors: Hisamine Kobayashi, Nagoya; Hironari Murase, Tokai, both of Japan

[73] Assignee: Tipton Corporation, Aichi, Japan

[21] Appl. No.: 361,553

[22] Filed: Dec. 22, 1994

[30] Foreign Application Priority Data

Dec. 22, 1993 [JP] Japan ..... 5-324556

[51] Int. Cl.[6] ..... B24D 3/34; B24D 17/00

[52] U.S. Cl. ..... 51/293; 51/298

[58] Field of Search ..... 51/293, 295, 298; 264/299, 319

[56] References Cited

U.S. PATENT DOCUMENTS

| | | | |
|---|---|---|---|
| 3,048,482 | 8/1962 | Hurst | 51/298 |
| 4,652,274 | 3/1987 | Boettcher et al. | 51/298 |
| 4,735,632 | 4/1988 | Oxman et al. | 51/295 |
| 4,773,920 | 9/1988 | Chasman et al. | 51/295 |
| 5,011,513 | 4/1991 | Zador et al. | 51/295 |
| 5,014,468 | 5/1991 | Ravipati et al. | 51/295 |
| 5,152,917 | 10/1992 | Peiper et al. | 51/295 |
| 5,247,765 | 9/1993 | Quintana | 51/309 |
| 5,304,223 | 4/1994 | Peiper et al. | 51/309 |

*Primary Examiner*—Deborah Jones
*Attorney, Agent, or Firm*—Wenderoth, Lind & Ponack

[57] ABSTRACT

Abrasive media formed into shapes or packs containing a compound are disclosed. The abrasive media are formed from a synthetic resin material, and contain a compound and abrasives within the formed synthetic resin material. A method of manufacturing such abrasive media is also disclosed. The method includes providing abrasives, synthetic resin and compound in their respective specific proportions, stirring them into a uniform mixture, placing the mixture into a mold, and thermosetting the same within the mold, and then removing it from the mold.

8 Claims, 1 Drawing Sheet

ABRASIVE MEDIA CONTAINING A COMPOUND FOR USE IN BARREL FINISHING PROCESS AND METHOD OF MANUFACTURE OF THE SAME

BACKGROUND OF THE INVENTION

1. Field of the Invention

The present invention relates generally to abrasive media formed into shapes or packs of particular sizes containing a particular compound or compounds that may be used in a barrel finishing process, and a method of manufacturing such abrasive media.

2. Description of the Prior Art

During a barrel finishing process, a particular compound (in the form of a liquid or powder) is usually fed into the barrel finishing machine at the time when abrasive media are fed. The compound is a chemical accelerator to effectively assist in the physical finishing of surfaces by abrasive media. It serves a variety of functions. It is useful in increasing cutting efficiency, physical chemical polishing, cleaning, luster finishing, color tone and rust preventing, etc. For the automatic feeding of such compound, a feeder that supplies an adequate quantity of compound is installed in the barrel finishing machine (as disclosed in Japanese examined Utility Model publication No. 55 (1980)-46432 and Japanese examined Patent publication No. 53 (1978)-13079).

The quality and quantity of a particular compound to be used in the barrel finishing process depends upon the particular requirements for the barrel finishing process (such as rough finishing, mirror-polishing, processing period of time (duration), etc.), and must also be determined from the shape, quality, and other parameters of workpieces being processed. In addition, different compounds must be fed and handled in different manners, depending upon whether the compound is fed in the form of liquid or in the form of powder. For the automatic feeding of a particular compound, the appropriate automatic feeder for that particular compound must be chosen and installed, depending upon whether the compound is being fed as liquid, or in the powdery form.

Usually, a compound is degraded over time during the barrel finishing process that continues for a long period of time, and then an additional, appropriate quantity of the compound must be fed at specific time intervals.

SUMMARY OF THE INVENTION

The present invention eliminates the problems of the prior art as described above, by providing abrasive chips formed like packs (referred to hereinafter as "abrasive media", except otherwise specified) of particular shapes and types that contain appropriate types and quantities of both abrasives and compound.

For example, by identifying the particular abrasive media that meet the particular type of workpieces being processed and the particular requirements for the barrel finishing process, the user or operator can easily select and use those abrasive media that contain the appropriate type and quantity of a particular compound, which can meet the particular workpieces and barrel finishing process requirements.

One object of the present invention is therefore to provide abrasive media formed from any synthetic resin material that contains specific quantities of a specific compound and abrasives. Specifically, the abrasive media of the invention contain a proportion of a compound equal to 0.1% to 10% by weight. Preferably, the compound may be composed of at least one surfactant, and any one of any anticorrosive, chelating agent and detergent builders, or any combination of any of these elements.

Another object of the present invention is to provide a method of manufacturing an abrasive media containing compound, comprising the steps of preparing specific proportions of abrasives, synthetic resin and compound, mixing them uniformly by stirring, adding any hardener to the resulting mixture and stirring them, placing the resulting mixture into a mold, allowing it to harden, and removing it from the mold.

It is found that less than 0.1% by weight of compound is not capable of performing its function, while more than 10% by weight of compound causes more wear on the abrasive media, which renders those abrasive media not usable for industrial applications.

The surfactants that may be used for the purposes of the present invention preferably include anionic surfactants such as fatty acid salts (such as sodium laureate, sodium palmitate, sodium stearate, etc.), or sulfonated compounds (such as sodium alkylaryl sulfonate, etc.), and nonionic surfactants such as polyethylene glycol mono-laureate, polyoxyethylene alkyl aryl ether, polyoxyethylene sorbitan mono-laureate, alcohol ethoxylate, alkanol amide (such as coconut oil fatty acid di-ethanol amide, etc.), which may be used singly or in any combinations. Those surfactants may be used for the purposes of cleaning, brightening, and lubricating.

The anticorrosive agents that may be used for the purposes of the present invention preferably include nitrite, borate, phosphate, aromatic carboxylics and the like, which may be used singly or in any combination.

The chelating agents that may be used for the purposes of the present invention preferably include oxycarbonic acids (such as citric acid, malic acid, tartaric acid, glycolic acid, glucuronic acid, etc.) or salts thereof, or amino polycarbonic acids (such as ethylenediamine tetra-acetic acid, diethylenetriamine pentaacetic acid, nitrotriacetic acid, glycolether diamine tetraacetic acid, etc.) or salts thereof, which may be used singly or in any combinations. Those chelating agents may be used for converting hard water into soft water.

The detergent builders that may be used for the purposes of the present invention preferably include powdery celluloses (wood powders, corncobs, chaff powders, etc.) or carboxy methyl cellulose.

The synthetic resins that may be used for the purposes of the present invention preferably include polyester resins, epoxy resins, aramid resins, polycarbonate resins and the like. For example, 20% to 90% by weight of any of the synthetic resins listed above may be used, and 10% to 80% by weight of abrasives (such as ALUNDUM (trademark of aluminum oxide), white ALUNDUM, silica, CARBORUNDUM (trademark of silicon carbide), etc.) may be contained.

According to the present invention, the complete automatic feeding operation during the continuous barrel finishing process can be achieved by feeding abrasive media that contain the appropriate quantities of abrasives and compound. As those abrasive media are becoming worn during the barrel finishing process, the compound contained in the media will become exposed in the proportion that is equivalent to the amount of wear on the abrasive media. Thus, the long-term barrel finishing operation may be achieved.

According to the present invention, the abrasive media that contain the compound as described so far eliminate the need of feeding compound into the barrel during the finishing operation, and the automatic operations of barrel finishing can be achieved.

The compound contained in the individual abrasive media will not degrade, and will become exposed from the abrasive media as they become worn during the finishing operation. Thus, the compound can retain performance of the media for the long-term finishing operation.

The abrasive media that contain the proper proportion of compound can become worn properly, which prevents the abrasive media from being clogged.

These and other objects, advantages, and features of the present invention will become apparent from the detailed description of particular preferred embodiments that follows by reference to the accompanying drawing.

DESCRIPTION OF PREFERRED EMBODIMENTS

EMBODIMENT 1

Figure 1:
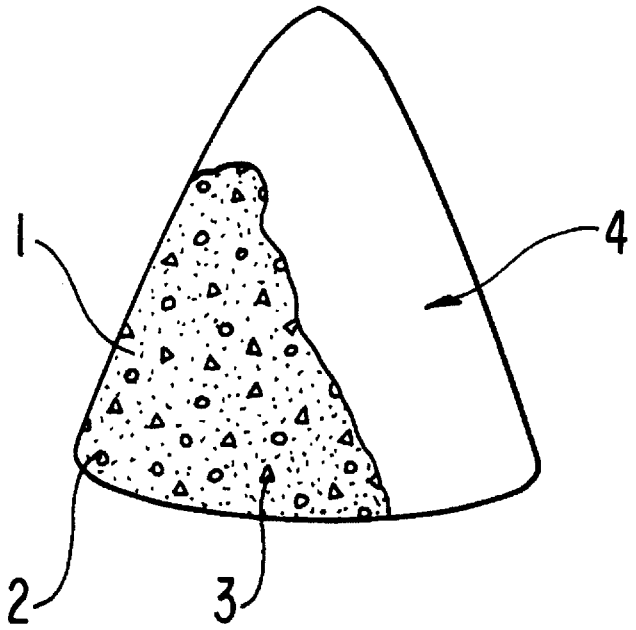
FIG. 1 illustrates a front view of abrasive media according to an embodiment of the present invention and is shown in a partial cross section.

Referring to FIG. 1, a single abrasive media 4 is shown. This media 4 contains the specific quantities of polyester resin 1, abrasives 2 and compound 3 which are mixed together uniformly. In the figure, a cone shape of media 4 is shown, but all possible shapes or forms of media that are now available in the prior art may be obtained, since the media are formed in a mold.

EMBODIMENT 2

In this embodiment, 49% by weight of polyester resin, 50% by weight of abrasives, and 1% by weight of surfactant are placed into a stirrer in which stirring occurs for 60 minutes. Then, 0.5% by weight of organic peroxide such as benzoyl peroxide, methyl ethyl ketone or the like is added as a hardener, and then the stirring occurs again for several minutes. The resulting mixture is placed into a particular mold, where it is heated at 60° C. to 80° C. for 5 to 10 minutes until it becomes hardened. After it has been cooled, it is removed from the mold. Abrasive media 4 as shown is obtained.

EXAMPLE OF TESTING

The testing takes place by using two different media each containing different percentages by weight of the same components as shown in Table 1, under the conditions as specified in Table 2. As specified in Table 1, the media obtained according to the present invention contain 49% by weight of polyester resin, 50% by weight of ALUNDUM (#1000), and 1% by weight of alcohol ethoxylate as surfactant. The media are formed like a cone of a diameter of 15 mm. For this testing, the centrifugal barrel finishing machine equipped with two-liter barrels is used with a carbon steel testpiece (SS-41-Japanese Industrial standards name), of which the surface was finished by abrasive belt #240 before testing.

TABLE 1

| | Materials | | |
|---|---|---|---|
| Product | Synthetic Resin | Abrasives | Compound |
| Invention | 49% Polyester | 50% ALUNDUM #1000 | 1% Surfactant |
| Prior Art | 50% Polyester | 50% ALUNDUM #1000 | 0% Surfactant |

TABLE 2

| | Finishing Conditions | | | |
|---|---|---|---|---|
| Time | Revolutions of machine | Amount Abrasive Media | Water | Amount Feeding Compound |
| 2 hours | 100 rpm | 1 L | 600 mL | 10 gr. |

Table 3 shows the results obtained under the conditions as specified in Tables 1 and 2.

TABLE 3

| | Results | | |
|---|---|---|---|
| Product | Brightness | Surface Roughness (Rz) | Stock removal |
| Invention | 31 | 0.85 μm | 832 mg |
| Prior Art | 7 | 0.95 μm | 302 mg |

Note: The brightness was measured by using the variable-angle glossmeter UGV-5D from Suga Tester Co., Japan. The greater values show the better brightness.

Table 3 shows that the product according to the present invention exhibits better brightness which is equal to 4.5 times the prior art product, and that there is no degradation in the compound. It also shows the surface roughness and the stock removal are better than those for the prior art.

In the above testing case, the abrasive media contained the surfactant as a compound that tends to be degraded due to finishing. Also, the testing took place by feeding a certain amount of compound containing at least the surfactant separately from the abrasive media at the beginning of the finishing operation. It is discovered from these experiments that the finishing process can occur without feeding such compound separately.

Of course, the abrasive media of the present invention containing a compound composed of anticorrosive, chelating agent or detergent builders, in addition to the surfactant, produce much better results.

Although the present invention has been described with reference to particular preferred embodiments, it should be understood that various changes and modifications may be made within the spirit and scope of the invention as defined in the appended claims.

What is claimed is:

1. Abrasive media for use in a barrel finishing process, said media consisting essentially of:

20% to 90% by weight of synthetic resin selected from the group consisting of polyester resins, epoxy resins, aramid resins, and polycarbonate resins, and combinations thereof;

0.1% to 10% by weight of a compound comprising at least a surfactant and a material selected from the group consisting of anticorrosives, chelating agents, and detergent builders, and combinations thereof; and 10% to 80% by weight of an abrasive selected from the group consisting of alumina, silica, and silicon carbide, and combinations thereof;

wherein said synthetic resin, compound, and abrasive are formed into a shape.

2. Abrasive media according to claim 1, wherein the synthetic resin material is a polyester resin.

3. Abrasive media according to claim 1, wherein said abrasive is alumina.

4. Abrasive media according to claim 1, wherein the shape is conical.

5. A method of manufacturing abrasive media for use in a barrel finishing process, said method comprising the steps of:

(a) providing a mixture consisting essentially of (i) 20% to 90% by weight of synthetic resin selected from the group consisting of polyester resins, epoxy resins, aramid resins, and polycarbonate resins, and combinations thereof; (ii) 0.1% to 10% by weight of a compound comprising at least a surfactant and a material selected from the group consisting of anticorrosives, chelating agents, and detergent builders, and combinations thereof; and (iii) 10% to 80% by weight of an abrasive selected from the group consisting of alumina, silica, and silicon carbide, and combinations thereof;

(b) stirring said synthetic resin, compound, and abrasives into a uniform mixture;

(c) adding a hardener to said mixture and stirring said hardener therein to form a second mixture;

(d) placing said second mixture into a mold; and (e) hardening said second mixture within the mold to form a molded shape and removing said molded shape from the mold.

6. Abrasive media according to claim 5, wherein the synthetic resin material is a polyester resin.

7. Abrasive media according to claim 5, wherein said abrasive is alumina.

8. Abrasive media according to claim 5, wherein the shape is conical.

* * * * *